United States Patent [19]

Merendino et al.

[11] Patent Number: 5,040,331

[45] Date of Patent: Aug. 20, 1991

[54] REMOTE CONTROLLED OPENING DEVICE

[75] Inventors: Paul A. Merendino, Mogadore; Fred I. Albrecht, Akron, both of Ohio

[73] Assignee: Albrecht, Inc., Akron, Ohio

[21] Appl. No.: 607,564

[22] Filed: Nov. 1, 1990

Related U.S. Application Data

[63] Continuation-in-part of Ser. No. 394,561, Aug. 16, 1989, Pat. No. 4,972,629.

[51] Int. Cl.[5] ..... E05F 15/20

[52] U.S. Cl. ..... 49/25; 49/28; 49/30; 49/138; 49/340; 49/345; 49/357

[58] Field of Search ..... 49/25, 28–31, 49/138, 339, 340, 346, 345, 357

[56] References Cited

U.S. PATENT DOCUMENTS

| | | | |
|---|---|---|---|
| 1,269,545 | 6/1918 | Mengedoht | 49/340 |
| 3,084,927 | 4/1963 | Linder | 49/340 X |
| 3,500,585 | 3/1970 | Vollmar | 49/340 X |
| 3,908,309 | 9/1975 | Coulter et al. | 49/31 |
| 4,367,610 | 1/1983 | Goode | 49/340 X |
| 4,658,543 | 4/1987 | Carr | 49/25 X |
| 4,658,545 | 4/1987 | Ingham et al. | 49/28 X |
| 4,713,545 | 12/1987 | Norrgren et al. | 49/25 X |
| 4,713,910 | 12/1987 | Quante | 49/25 X |
| 4,727,679 | 3/1988 | Kornbrekke et al. | 49/345 X |
| 4,750,118 | 6/1988 | Heitschel et al. | 49/25 X |

*Primary Examiner*—Philip C. Kannan

*Attorney, Agent, or Firm*—Oldham & Oldham Co.

[57] ABSTRACT

The invention relates to an automatic remote controlled opening device which may be used to open and close doors, windows or similar closure systems. The opening device includes a receiver to detect control signals generated at a remote location from the device. The control signals are then utilized to effect selective operation of a mechanical system coupled with the closure system for opening and closing thereof. The mechanical system enables smooth and efficient automatic opening and closing, but does not inhibit manual operation of the door or the like. Control circuitry associated with the device enables various functions to be performed for selective operation of the device. The device may also be provided with a stored energy source of power such that it can be retrofit for use with an existing closure system. Auxiliary control of the device enables opening or closing in response to an emergency situation or other circumstances.

13 Claims, 6 Drawing Sheets

REMOTE CONTROLLED OPENING DEVICE

BACKGROUND OF THE INVENTION

This application is a continuation-in-part of opening U.S. patent application Ser. No. 394,561 filed Aug. 16, 1989, now U.S. Pat. No. 4,972,629.

The present invention is directed to an automatic opening device which may be controlled from a remote location in response to a signal generated from a remote control signal generating means of one or more remotely located sensing devices used to generate remote signals. More particularly, the present invention is directed to an opening device which may be remote controlled and which includes means by which operation of the door can be selectively controlled to determine proper operation of the door upon actuation from a remote location.

There are known door opening devices such as utilized for opening and closing of swing doors wherein an operator may be mounted in close proximity to the door frame and coupled to the swing door to control the operation of the door. In U.S. Pat. No. 4,727,679, there is disclosed a system for automatically controlling operation of a swing door which includes an electronic controller responsive to various input signals such that initiation of an opening sequence may be accomplished by conventional actuation means such as floor mats or other conventional systems. After the door is opened, closing thereof occurs after a short delay. The electronic controller of this prior invention is responsive to an input signal to select a voltage value from an array of pre-established voltages so as to derive motor voltage and polarity signals therefrom. The motor drive shaft is coupled through a transmission system to an operator shaft which is in turn coupled to a mechanical linkage system comprising a bi-pivotal arm which is coupled to the door. The transmission system includes pulley belt units for translating motion of the motor drive shaft to an idler shaft, and the linkage system includes a crank arm coupled to the operator shaft at a fixed angular relationship to achieve leverage advantages. The device as shown in this prior patent is an industrial model door opening device which is commonly used at retail stores or other commercial areas and must operate from a 120 volt line source and effects intermittent opening of the door in response to a weight actuated floor mat control of the like.

Another example of automatic door opening and closing device are shown in U.S. Pat. No. 4,658,545 which includes a drive motor having its drive shaft coupled to a plurality of speed reducing, torque increasing pulleys and drive belts. A friction clutch connecting the drive train with the motor driven pulley is stated to prevent damage to the drive train in the event the door is blocked when the motor is energized and permits manual override of the system. The device is again actuated by means of a weight actuated floor mat control or the like and allows intermittent opening of the door, wherein the door will automatically close after providing a sufficient time for a pedestrian to clear the door area. Other automatic door opening devices are shown in U.S. Pat. Nos. 4,367,610 and 3,084,927.

There are also other systems which provide remotely controlled, opening and closing of doors, windows or the like such as found in U.S. Pat. No. 3,337,992. In this patent, a remote sensing device is utilized to actuate a mechanical door opening or closure system in response to various selected physical conditions or other criteria. This system includes programming means to control the overall operation of the system enabling various functions to be selectively achieved. The system is complicated and cumbersome to utilize effectively, and may be prone to breakdown and inefficient operation. Another system for opening and closing windows is shown in U.S. Pat. No. 3,257,757 utilizing vacuum pressure to affect opening and closing of the windows upon activation from a device coupled to the system at a remote location. Other systems are found in U.S. Pat. Nos. 4,660,324, and 4,598,494.

In the prior art, there has been found a need to provide a remote controlled opening and closing device for closure systems such as doors, windows and the like which has anon-board power source and will effectively operate to open or close the door or other device regardless of conditions which may exist which would inhibit operation of other known devices such as power outages, fires or similar occurrences. Additionally, it is desired that the remote control opening and closing device be easily installed so as to enable retrofitting to an existing door or window structure or which can be easily incorporated into a new construction. The device should be easily operated from a remote location by means of control signals sent from a hand held remote device having means to accommodate a variety of control signals to prevent accidental opening or closing from occurring based upon control signals generated from another remote device. It is also desired that the opening and closing system operate efficiently and over an extended period of time in a quiet and constant manner while being cost effective and convenient to use.

SUMMARY OF THE INVENTION

Based upon the foregoing, it is a main object of the present invention to provide a remote controlled opening and closing device which allows efficient and extended operation to automatically and selectively open or close a door, window or other closure system.

Another object of the invention is to provide an opening and closing device which can be operated from a hand-held remote signal generating device which sends control signals utilized by the opening and closing device to effect operation thereof. With such a system, the capabilities are expanded as a number of independent channels may be provided for operation of individual doors, windows or other closure devices. Similarly, user selection of the channels is provided to avoid interference from outside sources of signals which may induce accidental opening or closing of the closure systems.

It is yet another object of the invention to provide an auxiliary input for master control of all opening and closing devices regardless of the frequency at which they are tuned or external sources which may effect operation thereof making the system especially useful for emergency situations.

Another object of the invention is to provide an opening and closing system wherein the system is battery operated or includes a back up battery system for effective operation of the system regardless of power outages or other external variables which may inhibit operation of the system otherwise. Additionally, the system is provided with means by which battery power may be conserved so as to extend the useful life of the battery and reduce the necessity of recharging the batteries except at relatively long intervals during use of the system.

It is yet another object of the invention to provide an opening and closing system which is easily installed on existing door, window or the frames thereof for retrofitting the system easily and conveniently. Alternatively, the system can be mounted within a door frame or window frame during construction so as to incorporate the system easily into the new construction for use therewith.

Another object of the invention is to provide an opening and closing system which includes a slip clutch assembly which is adjustable to provide selective drive characteristics for a particular load as well as to enable manual operation of the door without harming the drive train of the apparatus.

Yet another object of the invention is to provide a control circuit which allows for selective operation of the opening and closing device upon actuation from a hand held remote control device, and yet is simple and cost effective in its construction.

It is yet another object of the invention to provide an optical feed back system which allows selective operation of the opening and closing device, and may provide control signals to the control circuit of the device to perform various functions such as controlling the speed of opening or closing initiated by the device.

Other objects and advantages of the invention are found in the ability to use this system with either right hand or left hand hinged closure systems, to provide latch control for a door or the like as well as providing adjustability of operation and selective control by the user.

These and other objects of the invention are accomplished by an opening and closing system comprising a small light weight mechanical system which will operate to smoothly and effectively open and close a closure device upon actuation from a remote control. The mechanical system includes a DC motor generating a desired drive output which is coupled to a gear reduction means for effectively transferring the driving power from the motor into the proper amount of torque and driving power for opening and closing a door or window. As the power or torque requirements may change with the load being operated on by the system, the system is adjustable to provide selected operating characteristics to accommodate such changes. An adjustable slip clutch assembly may be coupled to the driven shaft of the reducing gear to allow accommodation of the particular load being opened or closed by the system as well as allowing manual operation of the door. This system allows a wide variety of driving forces to be employed for different closure devices and does not require high power consumption or generate excessive heat which may present safety problems. The adjustable slip clutch also allows "soft" starts and stops as an additional safety precaution and helps to prevent damage to the closure device or system at the end of travel during opening and closing. The system also allows minimal restriction when non-actuated, to allow manual movement of the door whenever desired. The mechanical system is small and light weight and may be mounted on a door or window or the frame thereof and includes an adjustable arm linkage for retrofit installation. The system may be easily and conveniently installed using bolts or tape to conveniently mount the system. The mechanical system is effectively controlled by control logic and control circuitry to effect proper and selective operation of the system upon actuation from a remote control device.

BRIEF DESCRIPTION OF THE DRAWINGS

These and other objects of the present invention will be seen more distinctly with reference to the following detailed description of the invention in conjunction with the drawings wherein.

DETAILED DESCRIPTION OF THE INVENTION

Figure 1:
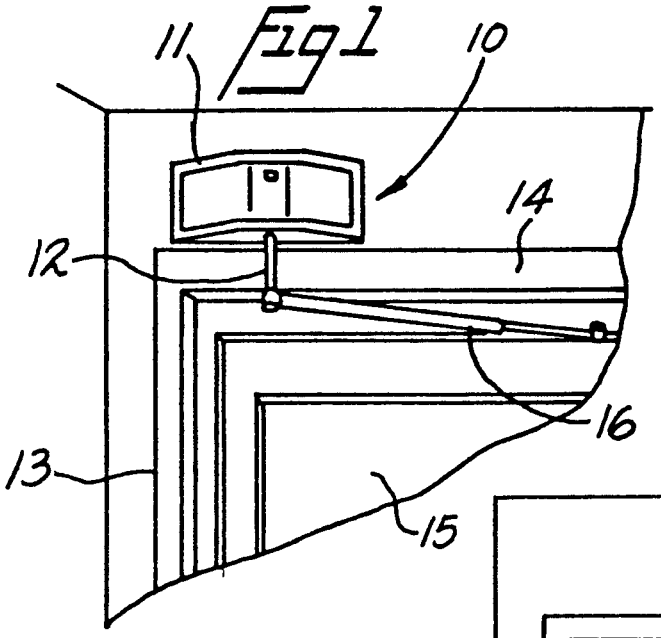
FIGS. 1 and 2 show alternative mounting positions for the automatic opening and closing device used in conjunction with a door.
Figure 2:
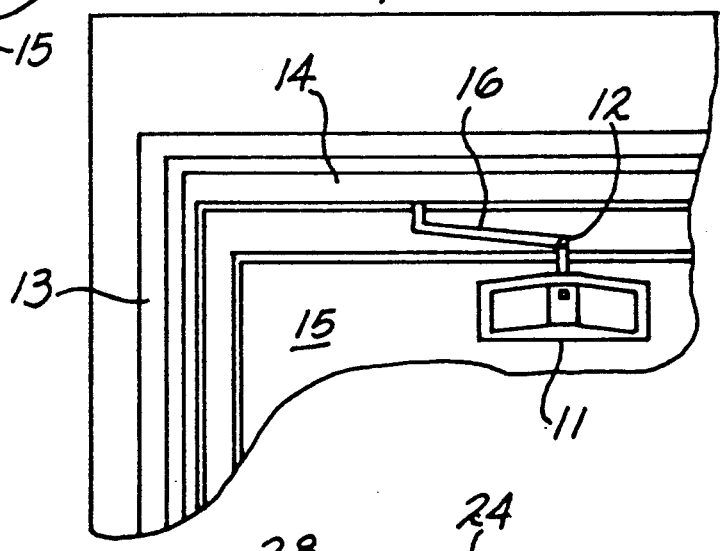

Turning now to the drawings, FIGS. 1 and 2 show several alternative installations for the opening and closing device of the invention. The automatic opening and closing device 10 comprises a small, light weight one-piece enclosure 11 from which extends a shaft 12 which is rotatably driven in alternate directions to effect opening and closing of a door or other closure system with which the device is used. As seen in FIG. 1, a door way including door jamb 13 and header 14 supports a door 15 normally pivotable by means of hinges or the like supported on the door jamb 13. The driven shaft 12 of the opening and closing device 10 is coupled to the door 15 by means of a linkage arm 16 which extends from the shaft 12 a distance away from the door jamb 13 to be coupled to the door 15 at a location near the center and at the top thereof. The housing 11 may be suitably positioned on the wall surrounding the door frame or supported on the header surrounding the door frame or supported on the header 14 and/or door jamb 13 as desired. The housing 11 is suitably installed using screws or adhesive tapes or other suitable means to properly position and secure the housing 11 on or near the door frame.

Alternatively, as seen in FIG. 2, the housing can mounted on the door 15 itself. In this installation, the driven shaft 12 extends either upwardly to support the linkage arm assembly which is coupled to the header 14 or other suitable location in the vicinity thereof. In either of the installations as seen in FIGS. 1 and 2, the opening and closing device will operate to effectively open and close the door or other closure system upon actuation of the device from a remote location. It should also be recognized that various other installations are possible such as mounting the housing 11 within a door frame or other frame such that only the linkage arm extends from the frame to be coupled with the door or other closure system associated with the frame. This installation can be accomplished at new construction sites whereas the installations as shown in FIGS. 1 and 2 allow the device to be retrofit into an existing closure system. When installing the device in new construction sites, the battery supply associated with the device, as will be hereinafter described, may be cut down significantly and the device only provided with a back-up battery system such that the housing 11 may actually be reduced in size significantly. For example, the housing 11 may be a molded plastic unit made in two separable parts wherein one part thereof may house the control circuitry and motor as well as the drive train of the device, and the other part may constitute a housing for a battery supply for use in an embodiment which may be retrofit with an existing door or closure.

Figure 3:
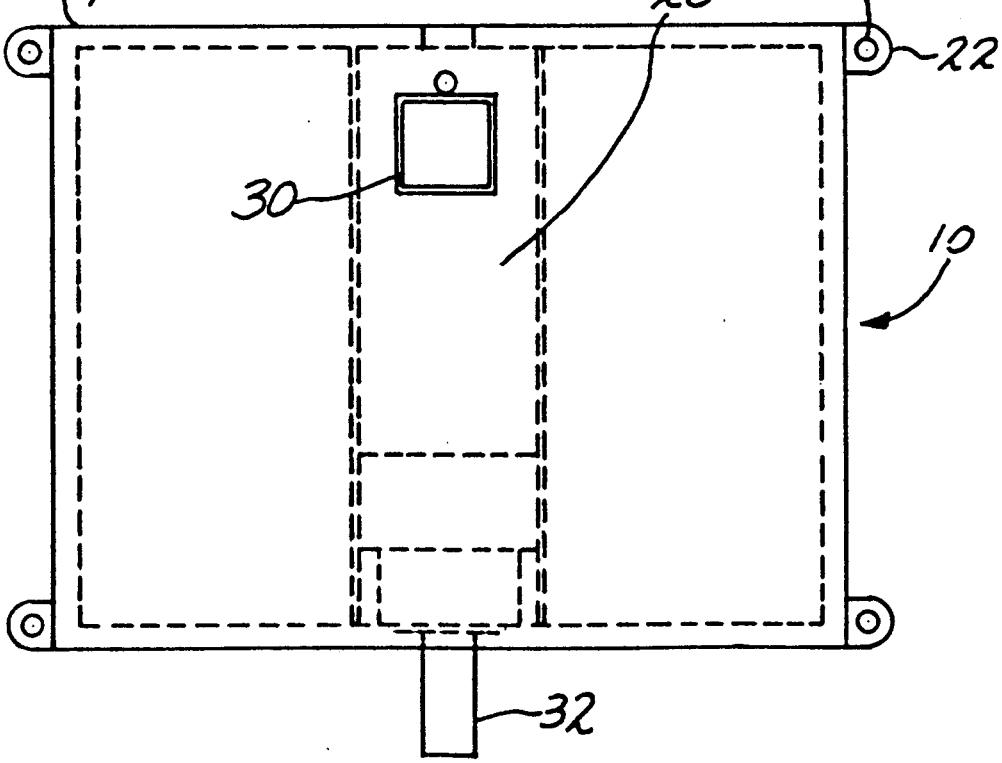
FIG. 3 is a front view of the housing of the opening and closing device.
Figure 4:
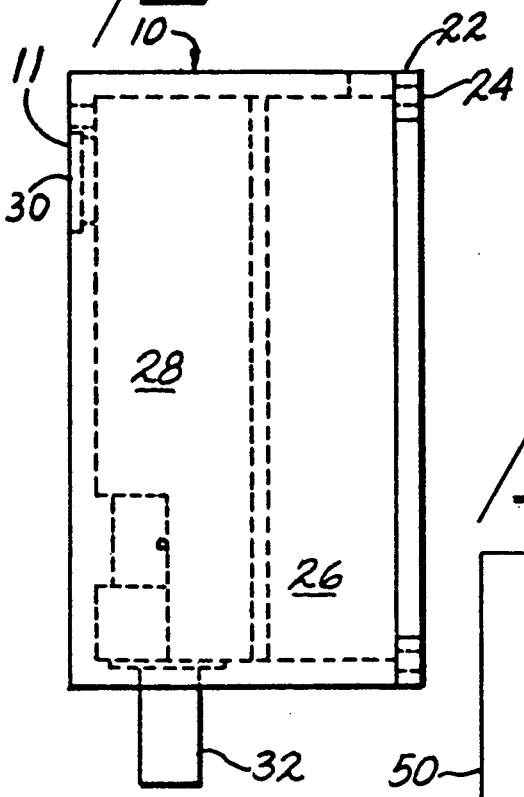
FIG. 4 is a side view of the device as shown in FIG. 3.
Figure 5:
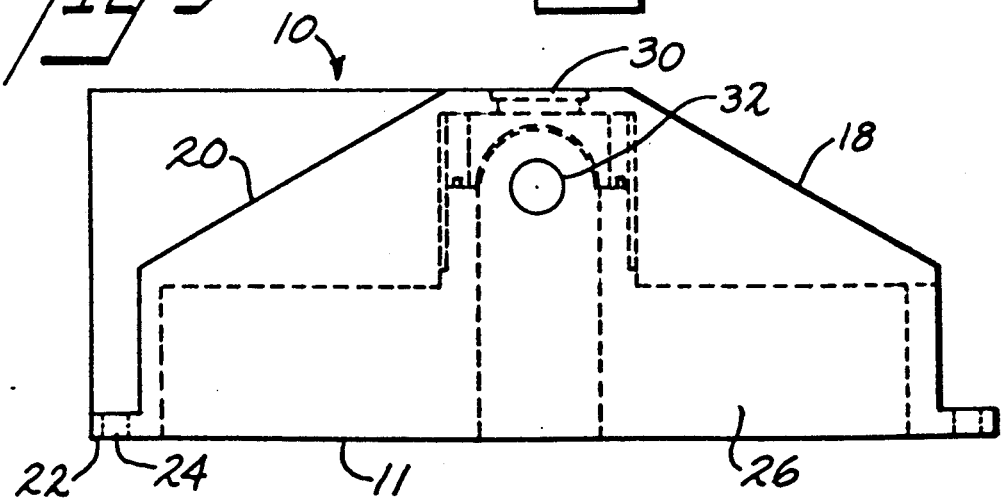
FIG. 5 is an end view of the device as shown in FIG. 3.

Turning now to FIGS. 3–5, the opening and closing device 10 is shown in more detail and comprises a low-profile housing 11 having general dimensions of approximately 8 inches in width, 6 inches in height and 5 inches in depth so as not to present a significant obstacle or problem for retrofit installation of the device. The low-profile housing also enables retrofitting of the device with an existing door or other closure system without presenting an unattractive appearance. As seen more distinctly in FIG. 5, the housing 11 may comprise two generally slanting front portions 18 and 20 so as to limit the extent that the device extends from the surface to which it is mounted. The housing 11 may include flanges 22 having apertures 24 therein through which a screw, bolt or suitable fastening means may be inserted and secured to the surface to which the housing 11 is mounted. The housing 11 includes a power supply such as one or more batteries 26 which may be laid flat in the housing 11 so as to reduce the bulk of the device 10. Alternatively, the device may be hard wired into an electrical system of a new construction site wherein the housing 11 may be diminished in size and mounted within the frame of a doorway or other area and be directly coupled to a source of AC current provided to a residential or commercial site. In the retrofit construction, the battery power supply operates to supply the necessary amount of DC current to motor 28 supported in housing 11. If the device is to be installed with new construction so as to enable hard wiring thereof, the battery supply 28 may be diminished so as to provide only enough power for operation of the device over a limited period of time such as emergency situations.

In the preferred embodiment, the housing 11 further comprises a receiving window area 30 for the reception of infrared radiation emitted by an IR transmitter to be hereinafter described. Control circuitry will allow reception of infrared radiation to initiate operation of the opening and closing device 10 to suitably open or close the closure system upon actuation of the device from a remote location. The control circuitry is coupled to the motor 28, which along with other mechanical drive means will output a driving force by means of output shaft 32. A linkage arm to be described more fully hereinafter is coupled to the output via 32 to translate the driving force of the output shaft 32 to open or close the door appropriately.

Also as seen in FIGS. 4 and 5, a control area 34 may be provided which enables user control of various operational functions of the device. As an example, the control area 34 may allow for user control of a latch release mechanism which may be associated with the device to allow selective latch release capabilities when desired. Additionally, the control area 34 may comprise an adjustment means for the speed of operation of the opening and closing device, wherein the speed may be varied over a predetermined range as best suited for the particular environment in which the apparatus is used. As mentioned previously, the device is usable for both right hand and left hand hinge doors or other closure devices, and therefore direction control may be set by the user at control area 34. Additionally, a channel select option is provided at the control area 34 to set the control circuitry to be matched with a remote controlled transmitter as will be hereinafter described. Also at control area 34, there may be provided a means to hook up a source of electrical current to affect recharging of the battery supply associated with the device.

Figure 6:
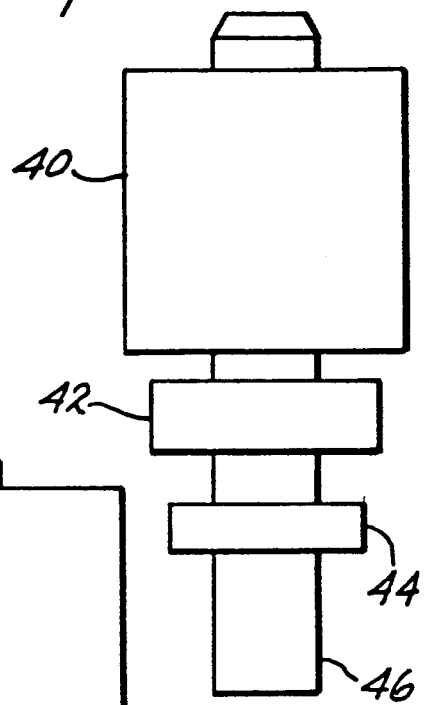
FIG. 6 is a first embodiment of the drive mechanism of the device.
Figure 7:
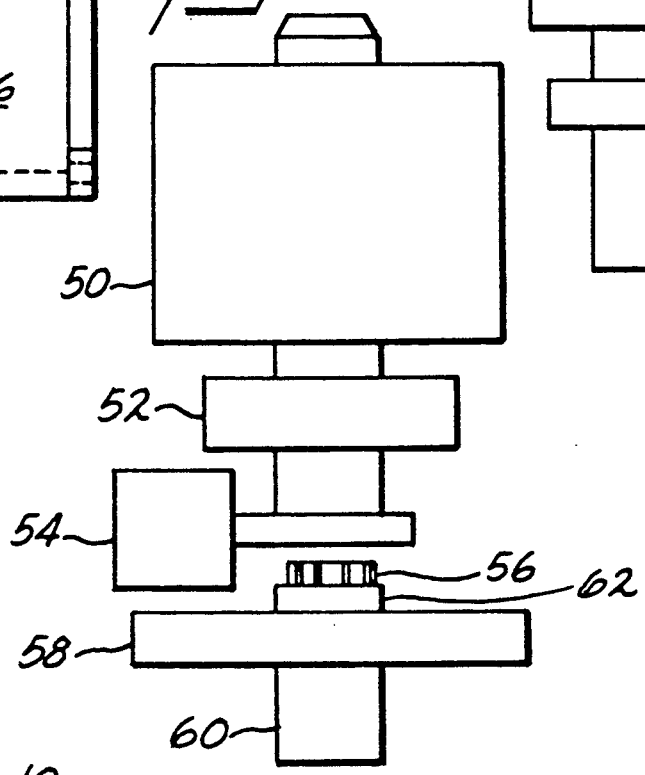
FIG. 7 is an alternate embodiment of the drive mechanism of the device.

Turning now to FIGS. 6 and 7, alternate drive mechanisms for the device are shown in more detail. In FIG. 6, a reversible DC motor 40 which is preferably of relatively low-speed, drives an output shaft at a desired speed to thereby generate torque for opening and closing a door or the like. In a preferred embodiment, the DC motor may provide an output drive of 2750 RPM which will provide the desired amount of torque to open and close standard sized doors or other similar closure systems. The motor 40 is coupled to a reducing gear 42 having a high reduction gear ratio to provide the desired amount of torque for the particular closure system with which the device is to be used. In a preferred embodiment, the gear reduction ratio may be 500 to 1 resulting in an output drive and torque which is suitable to open and close standard sized doors and similar closure systems. A slip clutch 44 may be utilized coupling the reduction gear 42 to the output drive shaft 46 selectively. The slip clutch 44 allows "soft" starts and stops while opening or closing and allows manual operation of the closure assembly while acting to prevent damage to the linkage assembly or motor of the device. The slip clutch 44 is user adjustable to set a "must drive torque" for the particular closure system with which the device is utilized.

The construction of the driving mechanism, either with or without the slip clutch 44, is designed to provide "soft" starts and stops for the closure system. During starting or stopping of the closure system, a constant amount of torque should be applied by means of the driving mechanism until the closure system is up to a desired operating speed wherein it will continue until the end of travel at which power will be cut or the speed will be reduced until stopped. The slip clutch 44 may be utilized to effect this type of operation or in a configuration without the slip clutch, current limiting may be provided to reduce the output drive of the motor for a period of time after actuation to effect a "soft" start and similarly may be slowed at the end of travel of the closure system. After the closure system has been brought up to a normal operating speed, the motor will require less current to maintain such a speed which can similarly be effected by current limiting circuitry.

Turning now to FIG. 7, an alternate embodiment of the driving mechanism is shown. In this embodiment, a reversible DC motor 50, similar to that described with reference to FIG. 6 is utilized. A reducing gear 52 is again utilized to provide the desired amount of torque and final driving speed for the output shaft 62. The output of the reducing gear 52 is coupled to a solenoid gear engaging mechanism 54 which when energized will couple the output shaft of the reduction gearing to the output shaft 62 at gear 56. An encoder 58 such as an optical encoder or optical feedback system, may be associated with the output drive shaft 60 so as to monitor rotation of the shaft 60 during operation. In this manner, the exact location of the closure system to which the opening and closing device is utilized can be monitored such that selective variable operation of the closure system can be effected. In this embodiment, the control circuitry to be hereinafter described may comprise position information and direction of travel information based upon signals received from the encoder 58 such that the closure system can be opened or closed only a selected amount and the end of travel can be effectively monitored to prevent damage to the linkage assembly or motor of the device.

With respect to the above described driving mechanisms, in a preferred embodiment, the output drive shaft 61 of the reversible motor is directly coupled to a drive plate 63 by means of a collar 64 which is tightened on output shaft 61 and the shaft of drive plate 63. Disposed between collar 64 and drive plate 63 is a driven plate 65 which is coupled to the drive arm 66, which is in turn coupled to the closure system. Between the drive plate 63 and driven plate 65 is disposed a friction disc 67 constructed of a special powdered metal or the like, which will transfer rotation of the drive plate 63 to the driven plate 65 upon application of enough pressure therebetween. The force between drive plate 63 and driven plate 65 which is placed upon friction disc 67 is user adjustable by means of a bellville washer 68 which is acted upon by a lock nut 69 to vary the downward force placed upon driven plate 65 and against the friction disc 67 relative to the drive plate 63. The bellville washer 68 acts to impart a spring bias force against driven plate 65 which is user adjustable by means of the lock nut 69 to create a desired "must drive torque" on the driven plate 65 which is attached to the drive ar 66 and to the closure system. The "must drive torque" may vary according to the particular conditions existing with respect to a particular closure system, and therefore adjustability of this torque allows flexibility in use of the invention. For example, depending on the weight of the closure system such as a door, the "must drive torque" will vary accordingly, and similarly extraneous conditions, such as wind or the like, may affect the opening and closing operation of the device which may require adjustment of the "must drive torque".

Figure 8:
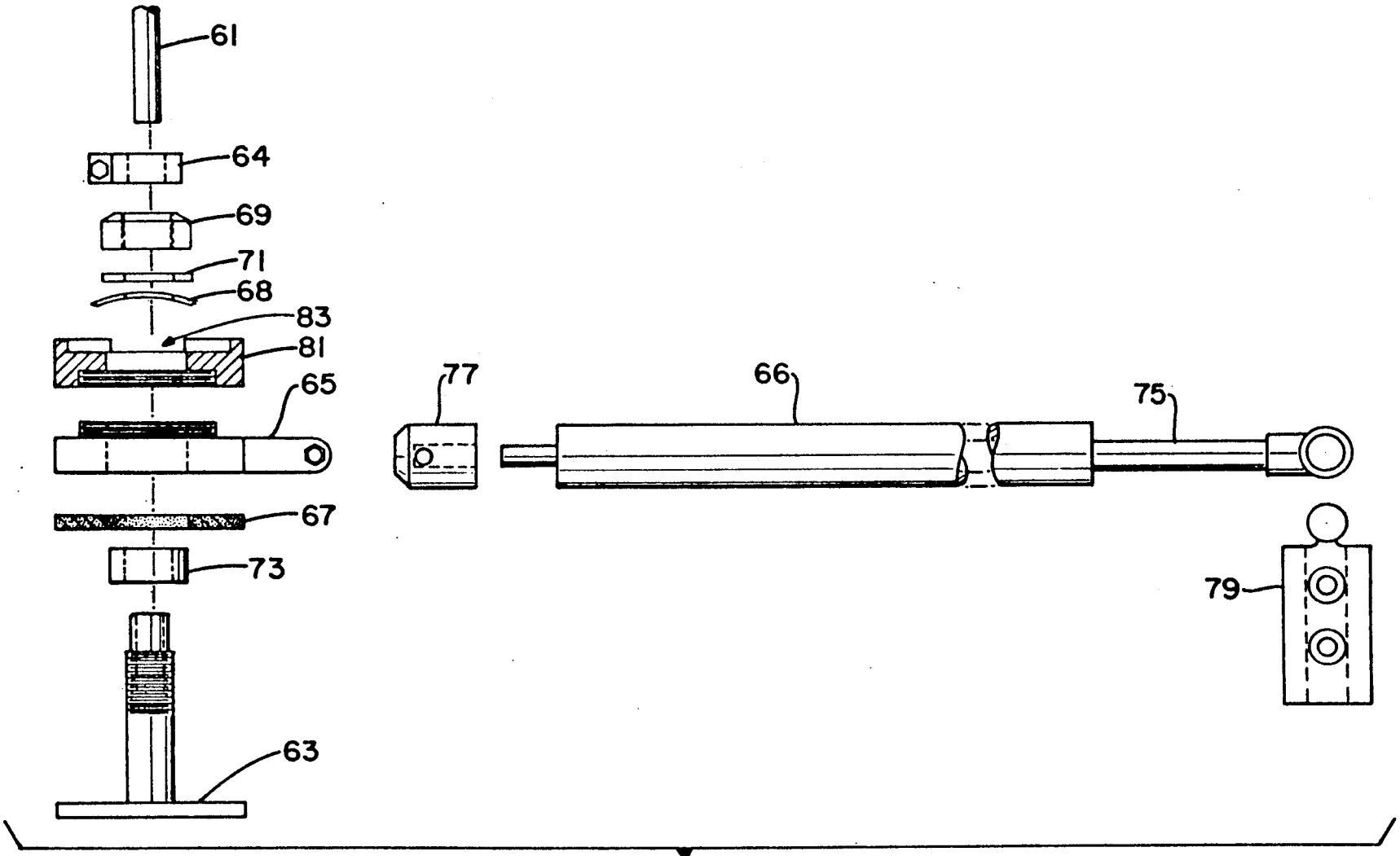
FIG. 8 is an exploded partial cross-sectional view of the drive mechanism and adjustable slip clutch arrangement of the invention.

It should also be recognized that the arrangement as described with reference to FIG. 8 creates a slip clutch which allows the user to adjust friction between the drive plate 63 and driven plate 65 for opening and closing using the device, but also allows other advantages as previously mentioned. For example, a slip clutch arrangement allows adjusting of the drive mechanism such that the "must drive torque" will assuredly open and close a door or the like by means of the device, but will also allow manual operation of the door without causing damage to the motor or gears of the system. The back driving torque associated with the motor or gears will be much higher then the "must drive torque" set by the user, which will allow slippage between the drive plate 63 and driven plate 65 in manual operation. Similarly, If an obstruction interrupts opening or closing of a door or the like, the slip clutch arrangement will allow slippage between the drive plate 63 and driven plate 65 as desired. Also, as previously mentioned, the slip clutch arrangement will allow initial slippage upon initiation of opening or closing of a door or the like to give the system the "soft" starting and stopping characteristics. As shown in FIG. 8, the drive system may also include a nylon washer 71 disposed between lock nut 69 and Bellville washer 68 to apply even force on Bellville washer 68 by means of lock nut 69. A bushing 73 may also align the driven plate 65 and friction plate 67 in centered and proper relationship to one another. With reference to the drive arm 66, a telescoping arm is shown to include telescoping portion 75, and is coupled to the driven plate 65 by means of an arm pivot 77 which allows pivoting of the drive arm relative to the driven plate 65 in a universal joint type arrangement to allow 360 degree movement of the drive arm 66 Vertical pivoting of drive arm 66 is provided in the event that the device is not mounted square with respect to the closing system which is attached to the drive arm telescoping portion 75 by means of retaining clip 79.

Also as seen in FIG. 8, there is provided a stop ring 8 disposed in the drive train relative to the driven shaft 61 of the reversible motor used in the device. The stop ring 81 is associated with the optical feedback system of the device which allows automatic stop and anti-slam operating characteristics as will be hereinafter described. The stop ring 81 comprises a cutout portion 83 which may have dimensions of approximately 100 degrees in angular extent to affect proper opening and closing of a door or the like which will move approximately 90 degrees from open and closed positions. The stop ring 81 is coupled to driven plate 65 for rotation therewith and relative to an optical feedback system as will be hereinafter described. It should be recognized that the cutout portion 83 may be varied to a great extent for a particular closure system with which the device is used, or may comprise a series of gaps or apertures formed in the stop ring 81 to monitor the position of the closure device over an entire 360 degree angular extent. The number of holes will determine the accuracy with which the optical feedback system can monitor the position of the door or the like and allows the optical encoder to sense the location of the door relative to the opening device at all positions. Such monitoring may be desired to control the motor speed depending on the actual position of the door when the device is initiated to open or close a door or the like, such that the speed of opening or closing may be smoothly controlled dependent on the position of the closure system. Such a feature would also allow information regarding the position of the door to be obtained after manual operation thereof, and such information may be used by an auxiliary control system to affect opening or closing of a plurality of doors or the like upon the occurrence of an emergency situation or to monitor opening or closing of doors or the like for security purposes. Such a feature may enable use of the opening and closing device in new construction while meeting all building code requirements associated with a particular situation.

In the preferred embodiment, it is desirable to provide a final drive of 0.2 to 0.3 RPM to provide quiet and constant motion of the closure assembly wherein a standard sized door may be opened from a closed position in any average of five seconds per 90 degrees of rotation of the door. It should also be seen that the drive mechanisms as shown in FIGS. 6–8, allow a closure system to be operated manually without substantial restriction to manual movement of the door or other closure system.

Figure 9:
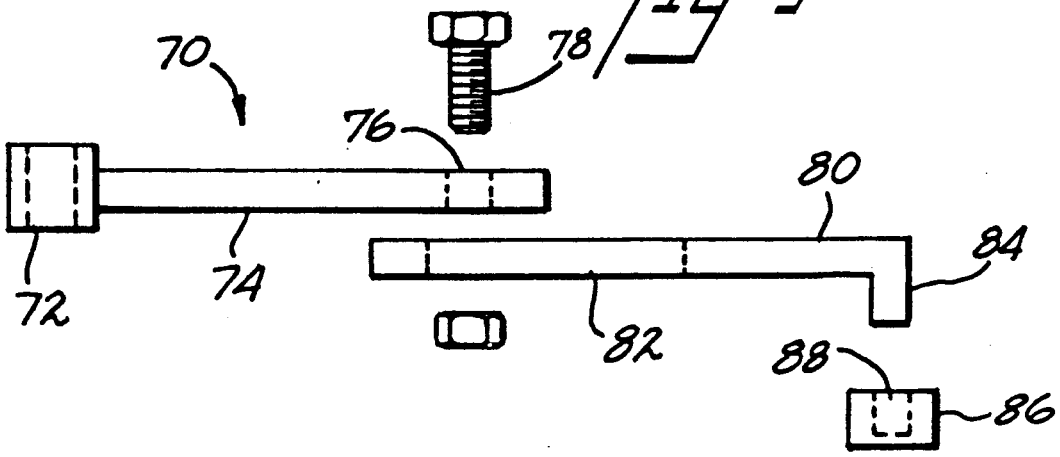
FIG. 9, 10 and 11 show various linkage arm assemblies which may be used with the device.
Figure 10:
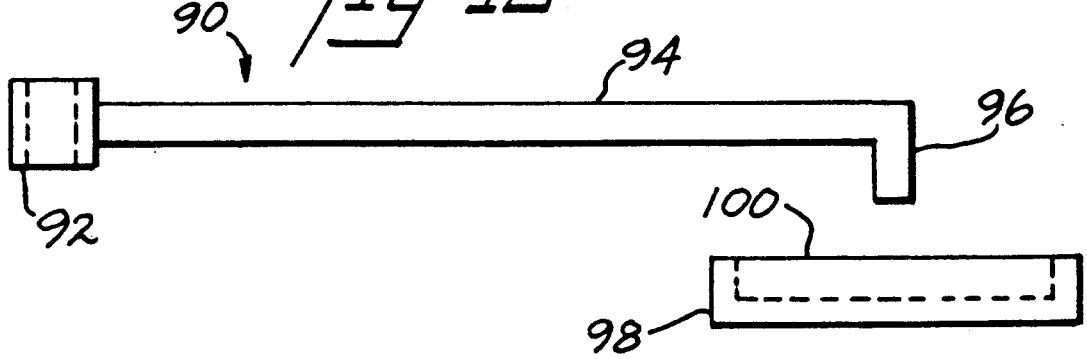
Figure 11:
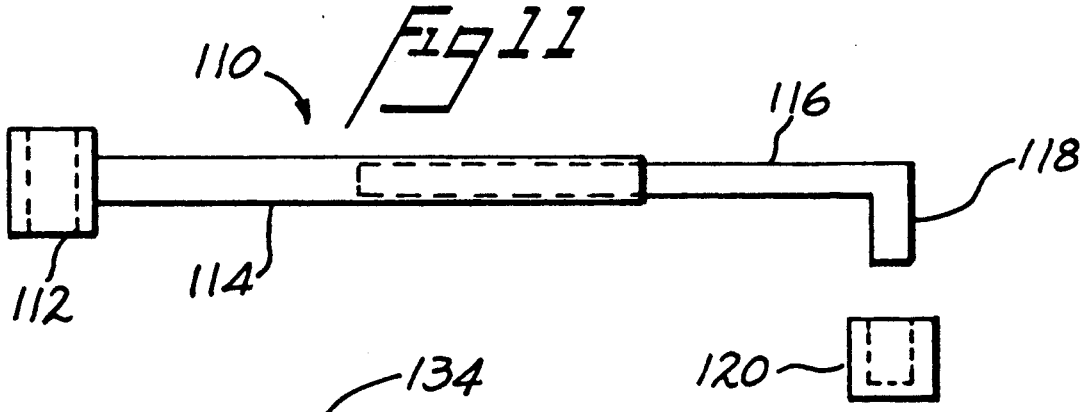

The opening and closing device mounted on a stationery surface in the vicinity of a closure system or on the closure system such as a door or window itself, is then coupled to the door or the like by means of a drive arm linkage assembly as described in FIG. 8. Alternate embodiments of the drive arm assembly are shown in FIGS. 9–11. As seen in FIG. 9, one embodiment of an adjustable arm linkage as shown at 70 comprises a head portion 72 having an aperture therein so as to be coupled with the driven plate associated with the driving mechanism of the device. The head portion 72 may be coupled to the drive mechanism to allow some movement in the vertical direction as well as rotation in accordance with the motor drive shaft. A first arm portion 74 extending therethrough at its outer periphery through which a coupling means such as bolt 78 may be inserted for securing to a second arm portion 80 having a longitudinal slot 82 therein. The slot 82 allows variable positioning of the second arm position 80 to the first arm portion 74 such that the linkage arm assembly 70 may be suitable coupled to a door, window of the like at the desired location regardless of the installation position of the housing. The second arm portion 80 includes an extending peg or rod portion 84 which is adapted to be received in a track portion 86 having a notch 88 therein which is mounted on the closure system or frame thereof depending upon the installation method utilized. In any event, the linkage arm assembly 70 should extend to approximately the center of the closure system such as a door, window or the like wherein the torque provided by the driving mechanism will operate to move the weight of the closure system for opening or closing thereof.

The linkage arm assembly 70 may be constructed of a plastic material which will effectively translate the torque provided by the driving mechanism to the closure system.

In an alternate embodiment as seen in FIG. 10, a one-piece linkage are assembly 90 comprises a head portion 92 similar to that previously described along with a first arm portion 94 having a predetermined length. An extending peg or rod portion 96 is formed on the outer periphery of the arm 94 which is adapted to coact with a track member 98 having a longitudinally extending groove 100 formed therein. The track member 98 is positioned such that the peg 96 will be inserted into the groove 100 to be movable in the confines thereof. Upon actuation of the opening and closing device, the peg 96 will move within the groove 100 until one end thereof is reached or friction between the peg 96 and groove 100 prevents further movement. In this way, the arm linkage assembly 90 is automatically adjustable over the extent of the track portion 98 wherein after relative movement of the peg 96 within groove 100 has stopped the torque provided by the driving mechanism will be transferred via the linkage arm 94 to the closure system.

Another embodiment of the linkage arm assembly is seen in FIG. 11, wherein the linkage arm 110 comprises a head portion 112 along with a first arm portion 114 being of hollow construction. A second arm portion 116 is adapted to be telescopically slidable in the first portion 114 for relative movement therebetween. The second are portion 116 includes as extending peg portion 118 adapted to be received in a track member 120 or a similar securing arrangement as previously described with reference to FIG. 8. In this embodiment, the linkage arm assembly 110 is automatically adjustable wherein the first arm portion 114 and second arm portion 116 will slide relative to 114 to one another upon actuation of the device. The torque generated by the drive mechanism will be transferred to the closure system effectively using a compact and cost effective construction.

Figure 12:
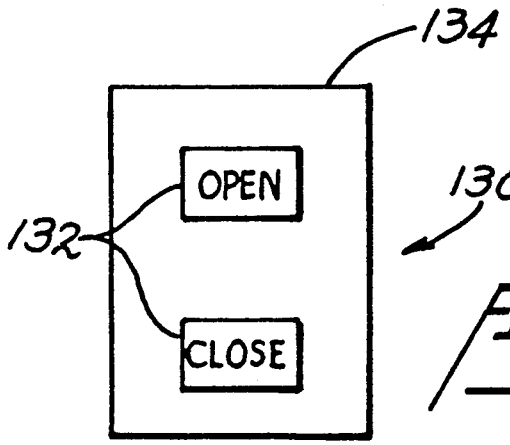
FIG. 12 shows a transmitting device for use with the invention to effect operation of the opening and closing device.

Turning now to FIG. 12, a simplified transmitting device is shown comprising a remote hand held transmitter 130 having a plurality of control switches 132 thereon. In its simplest form, the transmitter may comprise two switches to effect opening or closing of the closure system as shown. Alternatively, other control functions could be provided on the transmitter to enable variable operation of the opening and closing device from a remote location. In the preferred form, the hand-held remote control transmitter constitutes an infrared remote control having a window 134 on an edge thereof through which infrared radiation is transmitted. A plurality of discrete channels are provided such that the transmitter and receiver of the opening and closing device can be tuned to operate only on a selected channel. In this way, the opening and closing device can be tuned to prevent accidental operation thereof and to allow a plurality of systems to be operated in the same vicinity. For example, the remote control transmitter 130 could be provided with eight discrete channels having distinct codes. The remote control transmitter 130 may employ a coated matrix of $8 \times 2$ instructions, wherein eight pairs of instructions are selectively utilized to control closing and opening of a door or the like. The channel pair may be selected on the transmitter and matched at the receiver of the device. A transmitter integrated circuit and coated instructions will be described in more detail as the description proceeds. It should also be apparent that although the preferred form utilizes infrared signals to control function of the device, it should be recognized that these signals are directional and necessitate line of sight contact between the remote transmitter and receiver. Alternatively, radio signals or any other suitable information signals may be provided to effect operation of the device. It should also be recognized that the hand-held remote transmitter is only one way of actuating the device and other methods may be utilized as well. For example, remote sensing devices such as temperature, heat, smoke, moisture sensors or the like may be used to monitor physical conditions in an area and to transmit control signals to the opening and closing device if particular conditions arise. Thus, a temperature or smoke detector could be utilized to detect the presence of fire and to transmit an opening or closing control signal to the device. Such devices may also be mounted directly on the opening and closing device to effect automatic operation upon the occurrence of preselected conditions.

Figure 13:
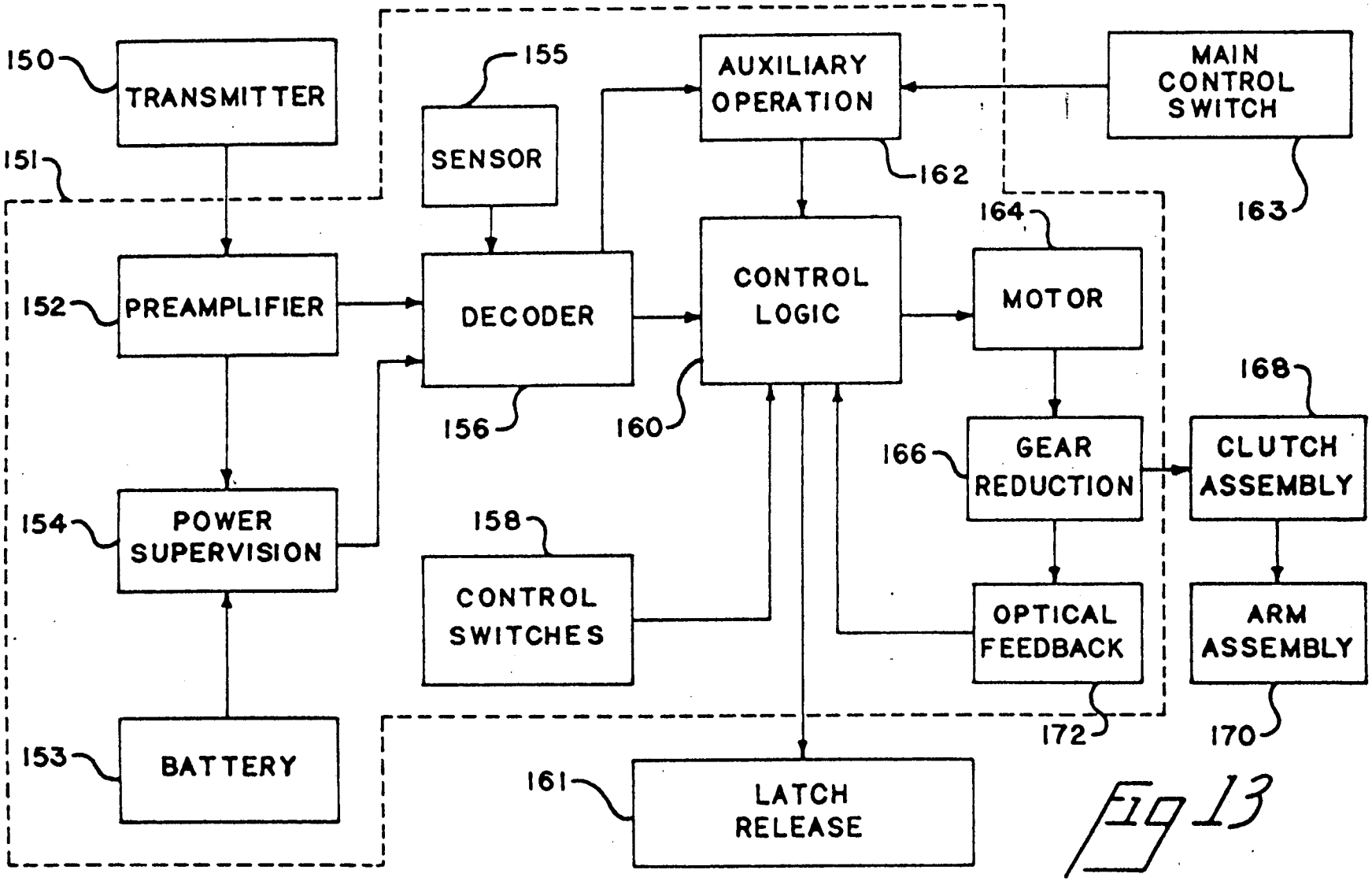
FIG. 13 is a block diagram of the components and control circuit of the opening and closing system.

Turning now to FIG. 13, the operation of the device and the control circuitry associated therewith will be described in more detail. A remote transmitter 150 is used to send signals to a receiver and preamplifier 152 associated with the device as indicated by line 151. Upon reception of control signals by preamplifier 152, a power supervision circuit 154 coupled to battery supply 153 is initialized to couple power to the remaining portions of the control circuit. As mentioned previously, the power supply may be a battery supply wherein conservation of the available battery power is necessary to extend the useful life of the device. By automatically placing the battery in a stand-by mode or eliminating power to various portions of the circuit when the device is not in use, the battery power can be conserved to extend the life thereof. Upon actuation of the device, power is supplied to the entire circuit to thereby place the device in an operational mode. For example, the battery supply of the device may comprise a plurality of rechargeable nickel-cadmium energy cells which when taken out of the circuit in the manner of the invention will enable approximately one year of battery life before recharging of the batteries is necessary. A recharging circuit (not shown) may be incorporated easily to recharge the batteries when necessary. Recharging may be accomplished by plugging in a recharger to the batteries, or permanently coupling the recharger in the device to eliminate the need for recharging. Alternatively, the device may include a permanently installed solar device which will act to constantly recharge the battery supply when light energy is present about the device.

After coupling the power supply to the recorder 156, the received signals will be transformed into control signals in conjunction with a user control switches 158 to supply these signals to control logic 160. The control logic 160 may be discrete logic or a microprocessor based system having programming information stored therewith. The control logic 160 may simply comprise opening or closing information to effect operation of the motor 164 in the desired direction or may include other information such as the relative position of the closure system or similar information for selective and variable control of the system. As previously described, the motor 164 may be coupled to gear reduction means 166 to provide a final drive for an output shaft which is in turn coupled to are assembly 170 through a clutch assembly 168 as previously described. An optical feedback system 172 may be associated with the output shaft of the motor 164 to detect the position of a door of the like continuously throughout its motion or at discrete points along its path.

The control logic 160 may also be coupled to a latch release mechanism 161 similar to that found in U.S. Pat. Nos. 3,804,442, 4,529,234 or the like. The control circuit will provide an appropriate signal to the latch release 161 to initiate release of the latch upon actuation of the device.

There is also provided an auxiliary operation circuit 162 coupled to the control logic 160 to effect operation of the opening and closing device by means other than the transmitter 150 or similar transmitting means. In one embodiment, the auxiliary operation 162 may be initiated upon reception of an override control signal generated at the location of the device itself. As an example, a sensing device 155 can be utilized to generate an override signal which can be coupled to decoder 156 which will transmit this control information to the auxiliary operation circuit 162 to effect the desired opening or closing of the closure system. Alternatively, the sensor 155 could be directly coupled to auxiliary operation circuit 162 for operation thereof. Auxiliary operation of the device may be desired when an emergency situation arises such that the device can automatically be operated based upon the occurrence of an override control signal.

Alternatively, in a hard wired embodiment of the invention, auxiliary operation may be effected by a centralized control means coupled to one or more of the devices. For example, a main control switch 163 could be physically coupled to the device for selective operation thereof which could be tied into the emergency system of the house or building in which the opening and closing device(s) are used. Alternatively, a signal may be provided on the electrical line coupling power to the opening and closing device as a modulated signal for selective operation of the device.

Auxiliary operation of the device may enable all doors of the like in a particular building or other structure to be selectively and automatically controlled in the event of an emergency or the like. As another example, the auxiliary operation capacity of the device would enable the status and position of all doors on the like to be monitored using the optical feedback system for security purposes. Similarly, if all doors or the like are to be closed or opened for some purpose, monitoring the position of each will facilitate proper operation upon initiation of the auxiliary control.

Figure 14:
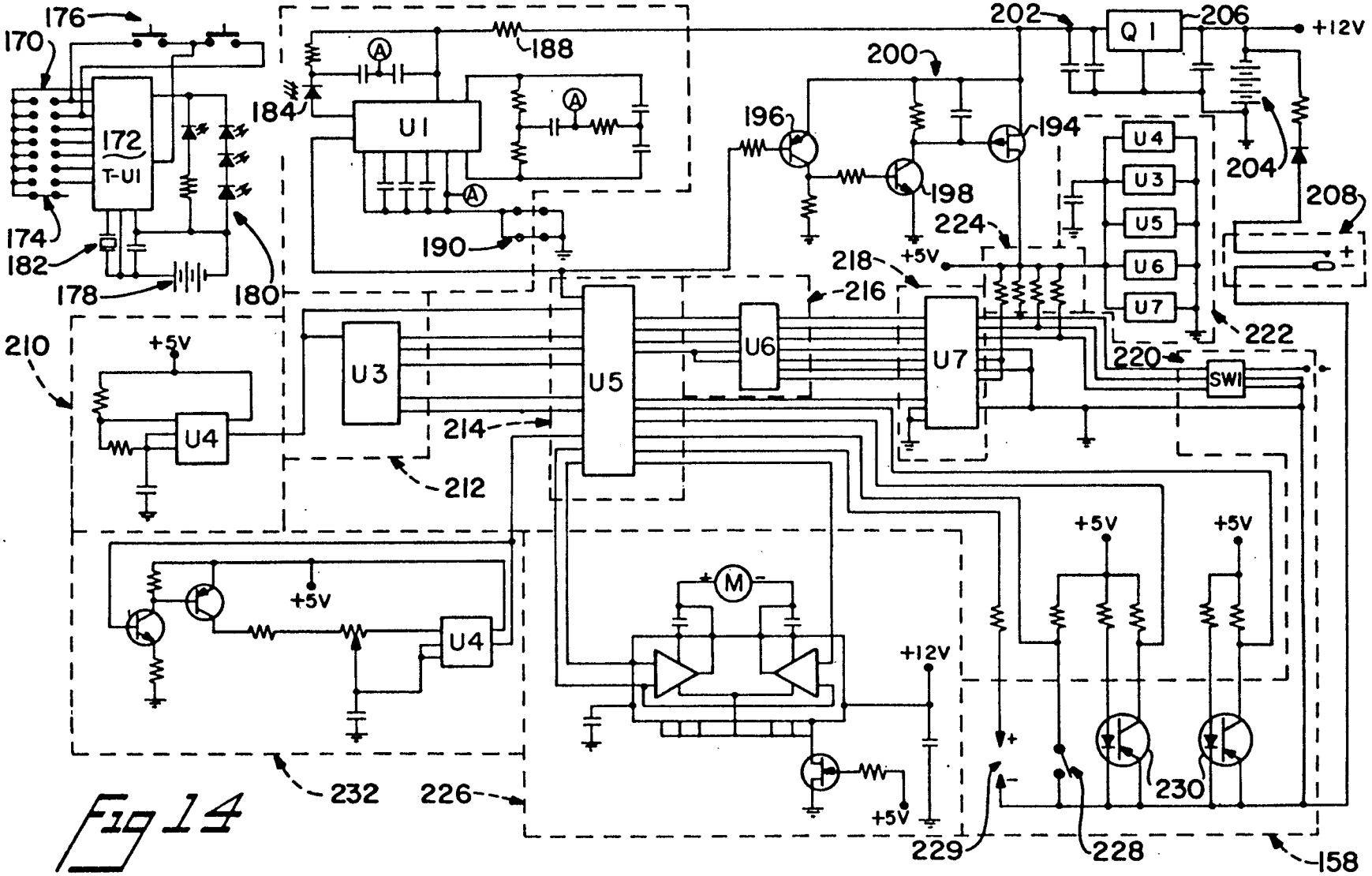
FIG. 14 is a schematic diagram of an embodiment of the control circuit of the invention.

Turning now to FIG. 14, one embodiment of the control circuitry associated with the device is shown in more detail. The control circuitry to affect operation of the opening and closing device first includes the hand-held remote controlled transmitter as previously described which is generally designated 170. The transmitter 170 includes a transmitter control IC 172 to develop appropriate signals to affect proper operation of the device. Eight pairs of coded messages may be selectively chosen by providing a strap 174 across contacts for each pair of coded messages. The user of the opening and closing device may selectively chose the desired code which then can be matched at the receiver. The codes developed by the IC 172 define bi-phase codes wherein each pair of codes will generate signals to open and close a door or the like by depressing the proper button 176 on the transmitter. The transmitter IC 172 is powered by a 9-volt battery 178 and drives a plurality of IR emitting diodes with pulses of current dependent upon the frequency of a resonator 182 in the circuit. Pulse of IR light containing modulated coded instructions are emitted from transmitter 170 to affect operation of the opening and closing device. The carrier frequency of the transmitter circuit is maintained constant and only the coded instruction is changed per the selected channel. It should be recognized that although eight channels are shown in the transmitter circuit 170, variations in the control circuitry would allow a large number of channels to be provided and selected by the user.

The pulses of IR light containing the modulated coded instructions are received at the location of the opening and closing device by light detecting device or photodiode 184. The photodiode 184 transforms the received IR energy to an electrical current, and will therefore indicate the presence of IR light. The current produced by the received IR light is small, and therefore must be boosted to a useable level for controlling operation of the device. Photodiode 184 forms part of an IR preamp structure generally designated 186, which may comprise an IR preamp IC such as produced by Siemens Electronic Corporation. The IR preamp 186 will look for the presence of IR light at the location of the device and will generate an output current in response to the presence of IR light. The IR preamp 186 is tuned to the frequency of the transmitter to receive the modulated coded instructions emitted with the pulses of IR light from the transmitter. The IR preamp 186 is always powered on and is coupled to standby voltage by means of electrical line 188 coupled to the power source of the device. In the control circuit as shown, a 5-volt standby voltage is provided to the IR preamp 186 at all times, but the IR preamp is chosen to provide very low current consumption in the standby mode. It should be recognized that IR light may be detected within a room or other environment as from sunlight or the like, and thus the IR preamp may look for a threshold difference in the amount of IR light detected thereby. Upon reaching a threshold level, an output current will be generated from the IR preamp at 190, which has been boosted to usable levels.

The output signal from the IR preamp 186 is directed to the power supervision circuit generally designated 192 includes an FET device 194, which acts as a knife switch being normally shutoff to prevent current from passing therethrough from the power source of the circuit. When IR light is detected, the IR preamp 186 will conduct current to the power supervision circuit 192 through a pair of transistors 196 and 198 wherein transistor 198 is inverted to supply a proper polarity current signal to turn FET 194 conducting within the power supervision circuit 192. Power supervision circuit 192 also includes an RC circuit at 200 having a redetermined time constant, such that once FET 194 is switched to be conducting, a time lag will be introduced wherein the signal will stay low based upon the time constant of the RC circuit to allow some time for the control circuit to recognize the control signals which have been received thereby. Upon switching the FET 194 to be conducting, power will be supplied to turn on all IC circuits of the control circuit, and to power up the entire circuit. Thus, it should be recognized that the power supervision circuit 192 will only provide power to portions of the control circuit upon reception of IR control signals from a remote control transmitter or the like. This will conserve battery power as desired so that the life of the battery power supply can be sustained over a long period of time. Power supply 202 may comprise battery supply 204 as described or may in AC line source as desired. The power supply 202 will produce a regulated voltage by means of IC 206 which as shown in the described control circuit regulates a 12-volt DC battery voltage to a 5-volt supply. The power supply 202 may also comprise a recharging circuit 208 to affect recharging of the battery supply continuously or when needed. The power supply 202 also has very low current consumption such that standby current drain is less than 600 micro amps for power supply 202 and preamp 186 Upon initiation of operation, the control circuit will operate at a current of less then 75 micro amps, and the recharge circuit 208 requires a recharge current of less than 200 micro amps. As described thus far, upon reception of IR signals from a remote control transmitter, the power supervision circuit will supply operating power to the control circuit as long as IR light is detected. It should be recognized that upon the first detection of IR light, operation of the circuit can be maintained until the door or other closure system is fully opened or closed as desired. Thus, the user can select intermittent or continuous operation by means of a control switch on the device as indicated in FIG. 13 at 158. For continuous operation, once an output signal is developed from the IR reamp, power supervision circuit may be able to provide operating current to all portions of the control circuit until an indication that a door or the like is fully opened or closed such as from an optical feedback system. In the intermittent mode, after the transmission from IR light from the remote controlled transmitter has stopped, the power supervision circuit will shut off supply power to the control circuit after the time constant of RC circuit 200.

When the presence of IR light is detected at the device, the power supervision circuit 192 will supply power to all of the IC's of the control circuit. When the control circuit is fired up in this manner, a clock 210 will regulate operation of the circuit. The clock 210 is coupled to a frequency divider 212 which divides the clock frequency into a variety of different signals for timing and proper operation of the circuit. As an example, the clock 210 may provide a 40 kilohertz output signal which is divided into a plurality of separate timing frequencies by divider 212. Timing signals are supplied to a logic IC 214 along with the control signals from IR preamp 186. Upon reception of the control signals by the logic IC 214, output instructions will be transmitted from the logic IC 214 to a shift register 216 along with the clock signals acting to regulate operation of the circuit. The state of the control signals received via the remote control transmitter are monitored after given amounts of time relative to the clock signal for decoding the received signal. Upon monitoring a transition in the instruction received from the remote control transmitter, the logic IC 214 will act to reset the clock, after which the state of the instruction is again monitored after a predetermined amount of time to decode the control signal. The information regarding the state of the coded instruction as determined by the logic IC 214 is saved to shift register 216 as it is obtained. The decoded and saved instruction from shift register 216 is transmitted to an octal comparator 218 where the decoded instruction is compared to the channel selected by the user at channel select circuit 220. The selected control signal provided by the channel select circuit 220 is defined by means of a plurality of IC's 222 which produces voltage potentials through resistors 224 and into the octal comparator 218. The channel select circuit 220 generates BCD signals which can be modified by means of a selector switch in the receiver.

Upon matching of an equivalent control signal from the remote control transmitter and the channel select circuit 220, the logic IC 214 will issue instructions to the motor 226 to affect opening or closing of a door or the like. The output shaft of the motor is made to rotate in either the clockwise or counterclockwise direction for opening and closing accordingly, which will obviously depend upon the orientation of the door or the like and the location and mounting of the device. As the device may be used with right hand or left hand doors or other closure systems, a direction control is provided with the control switches 158 as seen in FIG. 13 and as noted at 228 in FIG. 14. A latch release control signal is also generated at 229 to be utilized in conjunction with an automatic latch release device. The latch release 229 may also be selectively initiated by the user via a control switch.

Also shown in FIG. 14 is the optical feedback circuit which includes the stop ring as described with reference to FIG. 8. The stop ring again has a slot or opening in one side thereof over a predetermined angular extent relative to the maximum rotational movement of a door or other device. The stop ring rotates with the motor shaft and is coupled with two pairs of light emitting and receiving sensors 230 positioned at the end of travel of the door or the like in either the opening or closing directions. It should be recognized that the slot formed in the stop ring will allow light to be transmitted to the light receiving member of sensors 230 until the door or the like reaches a predetermined position in the opening or closing thereof to cut off the light transmission from LED to its receiver in the sensors 230. Thus, upon opening or closing of a door or the like, the optical feedback system is adapted to affect automatic stopping of the opening sequence of the system and to provide what may be termed "anti slam" characteristics in the closing sequence. When opening a door or the like, current will be conducted by the photoreceiver of sensors 230 which will enable control signals from logic IC 212 to be provided to motor 226 for operation of the motor in the proper direction. When movement of the door reaches a predetermined position such as 10° before fully opened, the stop ring will then prevent light from reaching the photo receiver of sensor 230 to thereby stop operation of the motor. When closing the door, the "anti slam" operation is initiated wherein normal operation will occur while current is being conducted from the sensor 230 until the door or the like is closed to a predetermined position, which again may be approximately 10° from fully closed. Upon reaching this position the sensor 230 will not be conducting current and the logic IC 214 will initiate "anti slam". In the "anti slam" mode, a pulse width modulation circuit 232 will be initiated to slow the speed of motor operation down to a selected closing speed. The pulse width modulation circuit 232 enables the duty cycle to be reduced by a predetermined amount such as 50% to thereby decrease the speed of closing to that predetermined amount. As the speed of opening or closing may vary with a particular door or other closure device, the user can set the normal speed of operation via the pulse width modulation circuit 232, and the "anti slam" mode will reduce the set speed by a predetermined amount near the closed position until the door or the like is fully closed.

It should be recognized that a stop ring and optical feedback system is described is only an example of an optical feedback system to control the final opening and closing sequences of a door or the like. Alternatively, the optical feedback system can monitor the position of the door or the like at all positions by a series of apertures in a stop ring can monitor the position of the closure system over a 360° extent. Such a system, a single chip micro processor may be utilized to control opening and closing of a door, and can operate to always start motor operation at a slow speed after which speed is ramped up to full speed operation and then ramped back down for smooth closing or opening of a door. Use of a single chip micro processor, although more expensive, would yield additional control over the opening and closing of a door or the like, and the control circuit as described would be modified accordingly. Use of a single chip micro processor in the control circuitry of the device is contemplated and embodied within the invention.

It should be recognized that the remote controlled opening and closing device of the invention achieves the objective as set forth to provide an efficient, cost-effective and simply installed and used system for automatically opening and closing a door, window or the like. The system can be retrofitted into an existing construction or incorporated into new construction, and includes battery power supply or backup power supply for operation regardless of existing conditions such as emergency situations.

It will be understood by those skilled in the art that the foregoing description is in terms preferred embodiments of the present changes or modifications may be made without departing from the spirit and scope of the invention as set forth in the appended claims.

What is claimed is:

1. A selectively operable automatic opening and closing device for use with a closure system comprising, a reversible motor means having a drive shaft to generate a driving force for opening or closing of a closure system, control circuit means associated with said motor means being responsive to a plurality of actuation signals to affect operation of said motor means to drive said drive shaft in a predetermined direction and at a selected speed dependent upon the position of said closure system, a drive train coupled to said output shaft including adjustable slip clutch means wherein said slip clutch means may be selectively adapted to slip during initial operation of said motor means to slowly initiate movement of said closure system, an adjustable linkage means coupled to said drive train and said closure system to translate said driving force of said output shaft to said closure system, remote signal transmission means adapted to selectively generate a plurality of actuation signals received by said control circuit means to affect operation of said motor means to selectively open or close said closure system.

2. The automatic opening and closing device of claim 1, wherein, said control circuit means includes a light detecting means which will first receive remotely transmitted optical actuation signals to generate control signals and a preamp to receive and boost said first control signals to useable levels in said circuit.

3. The automatic opening and closing device of claim 2, wherein, said control circuit means includes a power supervision circuit comprising an FET device normally in a non-conducting state which is coupled to said preamp wherein said preamp will supply a proper polarity electrical current signal to turn said FET device conducting to power up other portions of said control circuit means.

4. The automatic opening and closing device of claim 1, wherein, said control circuit means includes a clock means and a logic integrated circuit which receive said boosted control signals, wherein said logic integrated circuit will act to decode said first control signals to be matched with a stored instruction in said control circuit means wherein upon matching of said decoded first control signal and said stored instruction, the control circuit will initiate operation of said motor means to drive said drive shaft for opening or closing of said closure system.

5. The automatic opening and closing device of claim wherein, said control circuit means includes an optical feedback circuit comprising a means to monitor the position of said closure system and said optical feedback circuit generates second control signals adapted to affect automatic stopping of the closure system during an opening sequence or to slow movement of said closure system during a closing sequence thereof.

6. The automatic opening and closing device of claim 5, wherein, said means to monitor the position of said closure system is a stop ring coupled to said drive shaft of said motor means having at least one aperture therein which is associated with light emitting and receiving means positioned in fixed predetermined relationship to said closure system to define at least one predetermined position of said closure system wherein upon movement of said closure system, to said predetermined position, said aperture will allow light transmission from said light emitting means to said light detecting means to generate said second control signals.

7. The automatic opening and closing device of claim 6, wherein, said at least one aperture in said stop ring is a slot in one side thereof which extends over a predetermined angular extent relative to the maximum rotational movement of said closure system, wherein said slot will allow transmission of light from said light emitting means to said light detecting means at predetermined positions relative to fully closed or fully opened positions of said closure system to indicate the position of said closure system at said predetermined positions.

8. The automatic opening and closing device of claim 6, wherein, said stop ring includes a plurality of apertures therein which will allow light to be transmitted from said light emitting means to said light detecting means at a plurality of positions between fully opened or fully closed positions of said closure system to monitor the position of said closure system at a plurality of positions between said fully opened or fully closed positions.

9. The automatic opening and closing device of claim wherein, said control circuit means comprises a microprocessor means which is responsive to said plurality of actuation signals to develop control signals to initiate operation of said motor means to drive said drive shaft in a predetermined direction and at a selected speed to affect an opening or closing sequence for said closure system.

10. The automatic opening and closing device of claim wherein, said drive train further includes reducing gear means having a high reduction gear ratio to supply a desired amount of torque to said linkage means for opening and closing of said closure system.

11. The automatic opening and closing device of claim 1, wherein, said adjustable slip clutch means includes a drive plate coupled to said drive shaft of said motor means and a driven plate coupled to said linkage means, and having a friction disc disposed between said drive plate and said driven plate with means to apply an adjustable pressure between said drive plate and said driven plate by means of said friction disc to generate a predetermined torque on the driven plate upon rotation of said drive plate.

12. The automatic opening and closing device of claim 11, wherein, said means to apply an adjustable pressure between said drive plate and said driven plate is a Belleville washer acted upon by a lock nut, wherein said lock nut may be adjustably positioned against said washer to vary the downward force placed upon said driven plate and against friction disc relative to said drive plate.

13. The automatic opening and closing device of claim 1, wherein, said adjustable linkage means comprises a first arm portion rotationally coupled to said drive train, a second arm portion telescopically slidable within said first arm portion at one end thereof and having means at the other end thereof to secure said second arm portion to said closure system.

* * * * *